United States Patent [19]

Steiman et al.

[11] 3,963,150

[45] June 15, 1976

[54] PUFF-DISCHARGE SQUEEZE BOTTLE

[75] Inventors: Wolf Steiman; Steven W. Beres, both of Bridgeport, Conn.

[73] Assignee: VCA Corporation, Greenwich, Conn.

[22] Filed: May 21, 1974

[21] Appl. No.: 471,866

[52] U.S. Cl. ..... 222/211

[51] Int. Cl.[2] ..... B05B 11/04

[58] Field of Search ..... 222/193, 206, 209, 210, 222/211, 212, 213

[56] References Cited

UNITED STATES PATENTS

| | | | |
|---|---|---|---|
| 2,752,199 | 6/1956 | Newell, Jr. | 222/211 X |
| 3,221,945 | 12/1965 | Davis | 222/211 |
| 3,409,182 | 11/1968 | McDonnell | 222/213 X |
| 3,474,936 | 10/1969 | McDonnell | 222/212 |
| 3,733,010 | 5/1973 | Riccio | 222/193 |

*Primary Examiner*—Allen N. Knowles
*Assistant Examiner*—Hadd Lane
*Attorney, Agent, or Firm*—H. Gibner Lehmann; K. Gibner Lehmann; E. Donald Mays

[57] ABSTRACT

A squeeze bottle dispenser having a puff-type spray discharge characteristic. The bottle comprises a container having a flexible wall portion adapted to be squeezed in the hand of the user, a discharge nozzle, and a spring-urged check valve controlling flow to the nozzle. The valve includes a hollow valve housing with an annular valve seat, a ball-check engageable with the seat so as to seal the same, and a spring which normally biases the ball against the seat to seal the container and prevent leakage of its contents. The arrangement is such that when the container wall is squeezed, the ball-check initially prevents fluid from entering the valve housing until a predetermined pressure in the container has been attained, after which the spring yields somewhat, resulting in a sudden impulse or puff-type discharge through the nozzle. Means are provided for rapidly venting air into the dispenser following discharge, in order to relieve the vacuum therein, thus immediately readying the dispenser for subsequent actuation.

5 Claims, 12 Drawing Figures

PUFF-DISCHARGE SQUEEZE BOTTLE

BACKGROUND

This invention relates generally to squeeze bottle spray dispensers, and more particularly to dispensers of the type wherein the spray discharge has a particular characteristic or quality.

In the past a number of squeeze bottle dispensers have been proposed and produced. While conventional squeeze bottles incorporating merely a flexible walled container and spray nozzle generally operated satisfactorily, they all suffered a distinct disadvantage. The velocity and degree of fineness of the spray discharge were largely dependent upon the force with which the container wall was squeezed. Generally speaking, a relatively large squeezing force produced a higher velocity and a finer spray than a lesser squeezing force. In addition, since it was not possible to develop an instantaneous pressurizing of the container, the initial discharge from the dispenser (for the first fraction of a second) was in the form of relatively large droplets which were discharged at a rather low velocity. Similarly, at the end of the discharge when the squeezing force was removed, the spray velocity decreased gradually rather than halting abruptly, thus again giving rise to the formation of large droplets. Thus, a desirable high velocity, fine mist spray characteristic was not attainable at either the beginning or the end of the spray discharge interval.

Another construction involved a valved squeeze bottle wherein the valve was operated by the movement of one portion of the bottle wall (the bottom) when another portion of the wall was squeezed. Such a dispenser was adapted to produce a puff-type discharge. While this type of device generally operated in a satisfactory manner, the movement of the valve was found to be critical, and the tolerances required for realizing satisfactory operation of the squeeze bottle were rather strict.

SUMMARY

The above disadvantages and drawbacks of prior squeeze bottle dispensers are obviated by the present invention, which has for an object the provision of a novel and improved squeeze bottle device which is simple in construction, effective in operation and which can be constituted of few separate pieces which are capable of being molded of plastic in simple mold cavities. A related object is the provision of a squeeze bottle dispenser as above wherein an especially desirable puff-type discharge is realized, having the characteristic of a fine spray which is uniform essentially over the entire spray interval. Another object is the provision of a squeeze bottle dispenser which has a fast recovery time to enable a series of successive discharges to be readily effected.

The above objects are accomplished by a dispenser comprising a container having a flexible wall adapted to be squeezed in the hand of the user, a nozzle including a discharge orifice, and a spring-charged check valve which normally closes off the passage to the nozzle and prevents discharge therethrough until the pressure inside the dispenser has built up to a predetermined value. When this occurs, the spring yields slightly, opening the valve and enabling discharge of fluid through the orifice, such discharge having a sudden impulse or puff-type characteristic. The arrangement is such that spray begins and ends abruptly, producing an especially desirable, fine mist without the formation of large droplets or the spurting of fluid which is characteristic of most prior squeeze bottle devices.

Other features and advantages will hereinafter appear.

Figure 1:
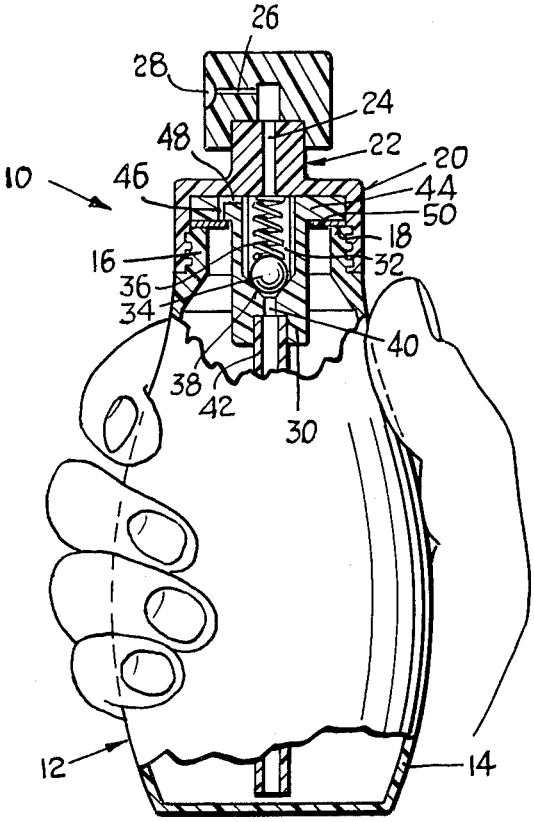
FIG. 1 is a vertical sectional view of the improved squeeze bottle dispenser of the present invention, the dispenser being shown in the non-discharging condition.
Figure 2:
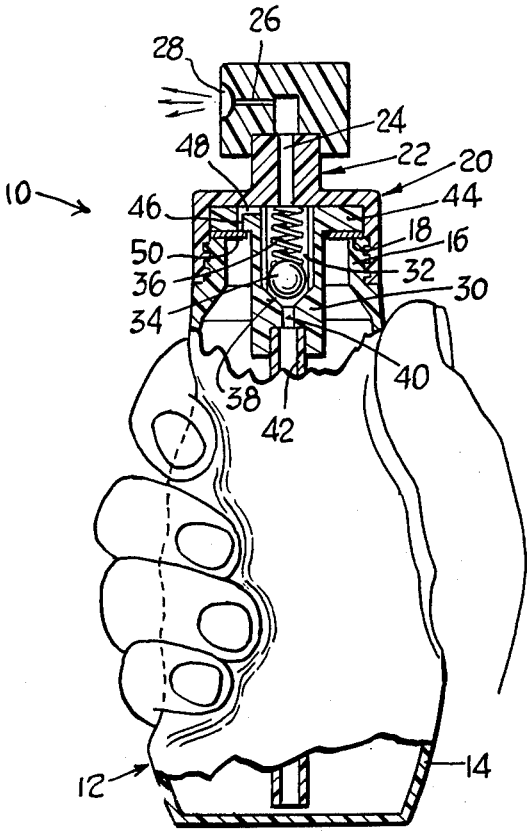
FIG. 2 is a view like FIG. 1, except showing the dispenser in the discharging condition.
Figure 3:
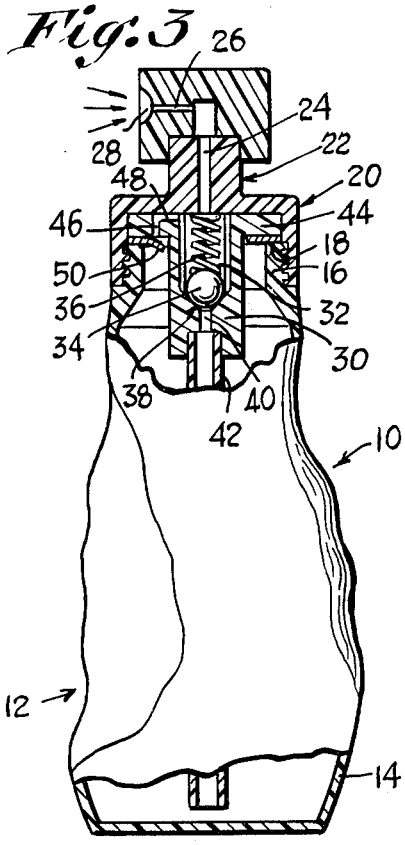
FIG. 3 is a view like FIG. 1, except showing the dispenser immediately following discharge, wherein the flexible wall of the container portion has been released but is still partially collapsed.
Figure 4:
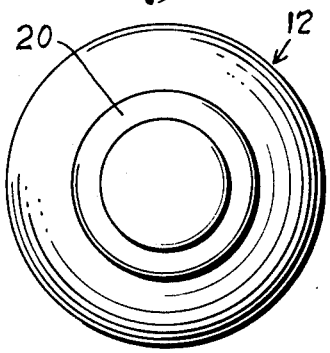
FIG. 4 is a top plan view of the dispenser of FIGS. 1–3.

Referring to FIGS. 1–3, there is illustrated a squeeze bottle dispenser generally designated by the numeral 10, comprising an upright container 12 having a movable, flexible wall portion 14 adapted to be squeezed by the hand of the user. The container has a threaded neck portion 16 and an annular lip 18. A screw cap 20 (FIG. 4) is received on the neck and carries a discharge nozzle 22, a part of which is shown as being integral with the cap. The nozzle has a hollow bore 24, a transverse passage 26, and a discharge orifice 28 communicating therewith.

Figure 5:
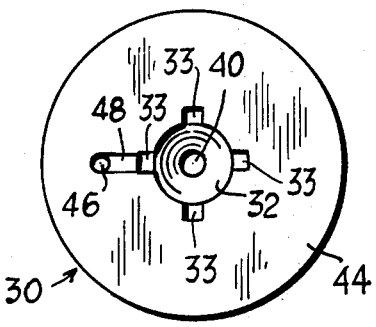
FIG. 5 is a top plan view of the valve housing part of the dispenser of FIGS. 1–4.
Figure 6:
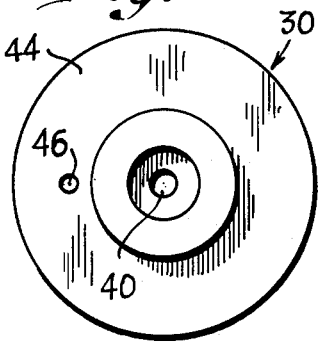
FIG. 6 is a bottom plan view of the valve housing part of the dispenser of FIGS. 1–4.

In accordance with the present invention, there is provided a novel spring-charged check valve assembly which operates to provide a puff-type discharge from the container. The assembly comprises a cylindrical valve housing 30 having a chamber 32, a ball-check 34 constituting a movable valve part, and a spring 36 carried in the chamber 32 and biasing the ball into engagement with an annular valve seat 38. The spring 36 is seated against the transverse wall of the screw cap 20. The housing is shown in FIGS. 5–6 and has an inlet port 40 into which there is pressed a dip tube 42 having one end extending to the bottom of the container. As shown in FIG. 1, the spring normally urges the ball 34 against the valve seat 38 so as to close off the inlet port 40. The chamber of the housing has a plurality of longitudinal grooves 33 (FIG. 5) which enable liquid to freely pass by the ball 34 during discharge of the dispenser.

Figure 7:
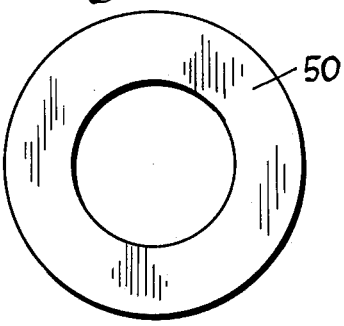
FIG. 7 is a top plan view of a sealing washer as employed in the squeeze bottle of FIGS. 1–3.

The valve housing has an annular flange 44 which is adapted to be clamped between the lip 18 of the container and the screw cap 20 when the dispenser is assembled, thereby securing the housing in place. In accordance with the present invention, there is also provided a venting valve means for introducing air from the nozzle 22 into the interior of the container so as to restore pressure (relieve vacuum) therein and enable the container movable wall 14 to expand to its normal position (FIG. 1) following discharge of the dispenser. As shown, the flange 44 closely abuts the underside of the screw cap 20, and a passage 46 extends completely through the flange 44, communicating with a groove 48 in its upper surface and defining an opening or hole on the lower surface of the flange 44 (FIGS. 1, 5). It is seen that the groove 48 and the underside of the screw cap 20 adjacent the groove define another passage, the two passages thus providing communication between the valve housing chamber 32 and the interior of the container 12. There is also provided a resilient and flexible valving flap in the form of an annular washer 50 (FIG. 7) which is clamped between the flange 44 and the container lip 18. The flap normally covers and seals off the opening of the passage 46 except for a short interval of time immediately following discharge of the dispenser, as will be explained below. The seal is sufficiently tight so as to prevent leakage of the contents into the chamber 32 even when the container is inverted.

The operation of the improved squeeze bottle dispenser can now be readily understood by referring to FIGS. 1–3. FIG. 1 shows the dispenser in the non-discharging condition. The ball 34 is shown sealingly engaging the valve seat 38, and the washer 50 is shown closing off the opening 46. When the wall 14 of the container is squeezed, as in FIG. 2, the pressure therein will begin to increase. By the present invention, the spring 36 is sufficiently stiff so as to prevent the ball 34 from being unseated during this initial pressure increase. A further increase beyond a predetermined point will cause an unseating of the ball 34 and a resultant flow of fluid from the dip tube 42 through the port 40 and chamber 32, the fluid being discharged through orifice 28. It is to be especially noted that such a discharge, when it occurs, results from a pressure in the container at least adequate to unseat the ball 34 against the action of the spring 36. As a result, the character of this spray is especially fine and uniform. In addition, the discharge commences as a sudden impulse of spray rather than as a gradual increase in flow as with conventional spray bottle dispensers, thus providing the desired puff-type characteristic. The discharging condition of the dispenser is shown in FIG. 2.

Upon release of the flexible wall 14, the pressure in the container gradually decreases and a point will be reached wherein the ball 34 will reassume a position engagingg the valve seat 38, thus abruptly halting the spray discharge. By such a construction there is prevented the formation of relatively larger droplets which would otherwise form when the pressure fell below a predetermined point. Such sudden halting also contributes to the puff-effect noted above.

FIG. 3 shows the dispenser immediately after discharge and after the wall 14 has been released, the latter being in a somewhat collapsed state. Due to the resiliency of the container wall, air will be drawn into the container through the nozzle 24, through passages 48, 46, and past the washer 50. The latter will yield as shown in FIG. 3 due to the pressure difference it experiences on its opposite sides. The flow of air will thus continue until the wall 14 is fully restored, after which the washer 50 will again seal off the end of the passage 46. The dispenser will then, as in FIG. 1, be ready for subsequent use.

Figure 8:
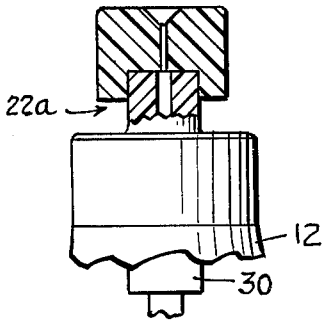
FIG. 8 is a fragmentary vertical sectional view of a modified squeeze bottle dispenser, constituting another embodiment of the invention.

FIG. 8 is a fragmentary view of a slightly modified dispenser wherein the discharge occurs from the top of a modified nozzle 22*a* instead of from the side as in the embodiment of FIGS. 1–3. The operation of this dispenser would be identical to that of the embodiment discussed above, and need not be repeated here.

Another embodiment of the invention is illustrated in FIGS. 9–12, showing a squeeze bottle dispenser generally designated by the numeral 52. As in the previous embodiment, the dispenser comprises a container 12 having a threaded neck, a valve housing 30 substantially identical to that illustrated in FIGS. 1–3, a screw cap 54, and a discharge nozzle 56 having a hollow bore 58. The valve housing has a passage 46 and grooved formation 48 as in the first embodiment. A resilient washer 50 is clamped between the flange of the valve housing 30 and the lip of the container neck, so as to normally close off one end of the passage 46.

In accordance with the present invention, the discharge nozzle comprises an orifice member 60 with a transverse passage 62 having an annular valve seat 64 at one end, and a discharge orifice 66 immediately adjacent thereto. The transverse passage carries a spring 68, which normally biases a ball 70 into engagement with seat 64. The latter is provided with a plurality of spiral grooves 72 which provide communication between the transverse passage 62 and the orifice even when the ball 70 is in engagement with the seat. These grooves are particularly illustrated in FIG. 12.

During the discharge of the dispenser, fluid from the valve housing enters the passage 62 and is forced past the grooves 72 and out through the orifice 66. The spiral grooves provide a swirling characteristic to the spray discharge. The spring-charged check valve comprising the housing 30, ball 34, seat 38 and spring 36 operate in the present embodiment in a substantially identical manner to the corresponding parts in the first mentioned embodiment.

Figure 9:
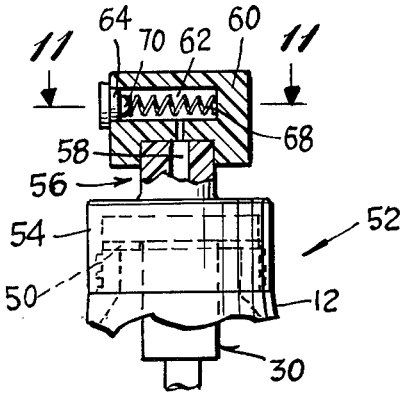
FIG. 9 is a fragmentary vertical sectional view of a still further modified squeeze bottle dispenser shown in the non-discharging condition, the dispenser constituting still another embodiment of the invention.
Figure 11:
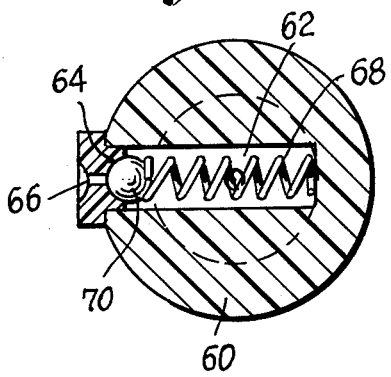
FIG. 11 is a section taken on line 11—11 of FIG. 9.
Figure 10:
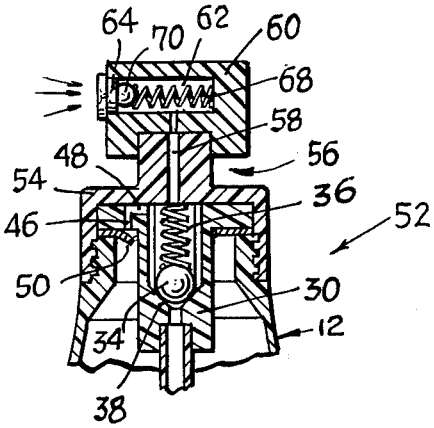
FIG. 10 is a fragmentary view like that of FIG. 9, except showing the dispenser immediately following discharge.
Figure 12:
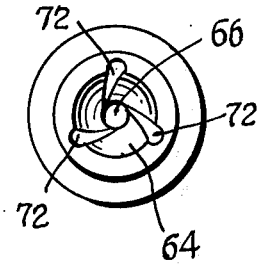
FIG. 12 is a rear elevation of the discharge orifice part of FIGS. 9–11.

Immediately following discharge and upon release of the flexible wall of the container, the dispenser will have the appearance as shown in FIG. 9. By the present invention, the inrush of air into the dispenser is greatly facilitated by the relief valve comprising the ball 70, spring 68, and valve seat 64. The slight vacuum which occurs in the container following release of the wall portion thereof will operate to cause the washer 50 to yield, uncovering the end of passage 46 in the valve housing 30. This pressure reduction is transmitted through the bore 58 of the nozzle 56 to the transverse passage 62, and effects a temporary shifting of the ball 70 toward the right in FIG. 9 to the position of FIG. 10 against the action of the spring 68, thus unseating the ball from the valve seat 64. When sufficient air has entered the container, the washer 50 will again close off the end of the passage 46, and the spring 69 will return the ball 70 to the position of FIG. 9 wherein the dispenser is ready for a subsequent discharge. By such an arrangement, considerably less time is required between a series of successive actuations, since the interval needed to enable restoration of normal pressure in the container is substantially reduced.

From the above it can be seen that we have provided a novel and improved squeeze bottle dispenser which is simple in construction, reliable in operation, and which provides an especially uniform puff or impulse-type spray discharge. The check valve is operated directly by pressure rather than by mechanical movement of a particular part of the dispenser, and thus problems with dimensional tolerances, friction, and wear are largely eliminated. The device thus represents a distinct advance and improvement in squeeze bottle technology.

Variations and modifications are possible without departing from the spirit of the invention.

We claim:

1. A squeeze bottle aerosol dispenser comprising, in combination:

a. a container having a neck portion and a movable wall portion adapted to be squeezed by the hand of the user, b. a cap on said neck portion having an outwardly directed discharge nozzle with a hollow bore, c. a hollow valve housing extending into said neck portion and having an annular flange supported by the rim of said neck portion and having an outlet communicating with said bore, d. a spring-charged check valve means including an annular valve seat disposed in the hollow of the housing, a ball movable in the housing and engageable with the seat so as to seal against the same, and a spring carried in the housing normally biasing the ball in engagement with the seat, and e. venting valve means carried by the container and communicating on the interior thereof for introducing air into the latter and relieving vacuum buildup therein following a discharge of the dispenser and release of the container movable wall, said venting valve means including a passage in said annular flange communicating with the interior of the container and with the hollow of the housing, and an annular, resilient, yieldable flap having its periphery gripped between said rim and the underside of said flange and normally covering one end of the passage but yielding in response to pressure buildup therein.

2. A squeeze-bottle aerosol dispenser comprising, in combination:

a. a resilient plastic container for holding a product to be dispensed from the container, said container having a flexible wall portion adapted to be squeezed by the hand of the user, b. a discharge nozzle connected with the container and having a hollow bore, c. a hollow valve housing having an outlet communicating with said bore, d. spring-charged check valve means in the housing including a compression spring, a ball abutting the lower end of the spring and a valve seat in the housing sealingly receiving the ball, said check valve means opening in response to a predetermined pressure buildup within the container thereby to provide a puff-type discharge at the nozzle, and e. a venting valve means comprising a passage means in an annular flange provided on said housing, which passage means communicates with the hollow in said valve housing, and a resilient, annular, yieldable flap normally seated against the outlet of said passage means in said flange opening to the interior of said container.

3. The invention as defined in claim 2, wherein:

a. said nozzle has a discharge aperture and a transverse passage communicating with said hollow bore, b. an annular valve seat disposed at the end of said transverse passage, c. said valve seat having a plurality of spiral grooves adapted to produce a swirl-type discharge therefrom, d. a ball carried in the passage, and e. means normally biasing said ball into engagement with said valve seat during discharge of the dispenser, thus channeling the substance to be dispensed through said spiral grooves, f. said biasing means yielding in response to flow of air into the discharge nozzle so as to enable a rapid relief of vacuum build-up in the dispenser following a discharge thereof and a release of its movable wall.

4. The invention as set forth in claim 2, and further including:

a. a closure cap carried by said container, said closure cap having a transverse wall, abutting the top of said annular flange, b. said passage means including a grooved formation on the surface of the flange and a portion of the transverse wall of the closure cap, and c. said grooved formation communicating with the outlet of valve housing.

5. The invention as defined in claim 4 and further including:

a. said container having an annular rim at its top, b. said flap comprises a resilient washer of annular configuration, and c. said washer being clamped between said rim and said closure cap when the latter is assembled to the container.

* * * * *